US009677033B2

(12) United States Patent
Krasnansky et al.

(10) Patent No.: US 9,677,033 B2
(45) Date of Patent: Jun. 13, 2017

(54) AUTOMATIC DISHWASHING DETERGENT

(71) Applicants: ROHM AND HAAS COMPANY, Philadelphia, PA (US); UNION CARBIDE CHEMICALS & PLASTICS TECHNOLOGY LLC, Midland, MI (US)

(72) Inventors: Robert Krasnansky, Le Rouret (FR); Severine Ferrieux, Grasse (FR); Bertrand Ammeux, Saint Cezaire sur Saigne (FR); Jan Edward Shulman, Newtown, PA (US); Eric P. Wasserman, Hopewell, NJ (US)

(73) Assignees: ROHM AND HAAS COMPANY, Philadelphia, PA (US); UNION CARBIDE CHEMICALS & PLASTICS TECHNOLOGY LLC, Midland, MI (US)

( * ) Notice: Subject to any disclaimer, the term of this patent is extended or adjusted under 35 U.S.C. 154(b) by 0 days.

(21) Appl. No.: 15/101,049

(22) PCT Filed: Nov. 21, 2014

(86) PCT No.: PCT/US2014/066886

§ 371 (c)(1),
(2) Date: Jun. 2, 2016

(87) PCT Pub. No.: WO2015/094583

PCT Pub. Date: Jun. 25, 2015

(65) Prior Publication Data

US 2016/0355756 A1 Dec. 8, 2016

(30) Foreign Application Priority Data

Dec. 20, 2013 (EP) ..... 13290322

(51) Int. Cl.

| | |
|---|---|
| ***C11D 1/722*** | (2006.01) |
| ***C11D 1/825*** | (2006.01) |
| ***C11D 3/02*** | (2006.01) |
| ***C11D 3/37*** | (2006.01) |
| ***C11D 1/72*** | (2006.01) |
| ***C11D 1/66*** | (2006.01) |
| ***C11D 3/08*** | (2006.01) |
| ***C11D 3/10*** | (2006.01) |
| ***C11D 3/33*** | (2006.01) |

(52) U.S. Cl.

CPC ..... *C11D 3/3769* (2013.01); *C11D 1/66* (2013.01); *C11D 1/72* (2013.01); *C11D 1/825* (2013.01); *C11D 1/8255* (2013.01); *C11D 3/08* (2013.01); *C11D 3/10* (2013.01); *C11D 3/33* (2013.01); *C11D 3/3757* (2013.01); *C11D 1/721* (2013.01); *C11D 1/722* (2013.01)

(58) Field of Classification Search

CPC ..... C11D 1/722; C11D 1/825; C11D 3/02; C11D 3/3746; C11D 3/3757

See application file for complete search history.

(56) References Cited

U.S. PATENT DOCUMENTS

| | | | | |
|---|---|---|---|---|
| 5,719,112 | A | 2/1998 | Gordon et al. | |
| 5,858,944 | A | 1/1999 | Keenan et al. | |
| 2007/0027265 | A1 | 2/2007 | Guzmann et al. | |
| 2010/0031976 | A1 | 2/2010 | Warkotsch et al. | |
| 2010/0294309 | A1* | 11/2010 | Tropsch ..... | C11D 3/378 134/18 |

FOREIGN PATENT DOCUMENTS

| | | | |
|---|---|---|---|
| EP | 2228426 | A1 | 9/2010 |
| EP | 2410041 | A1 | 1/2012 |
| JP | H10130697 | A | 5/1998 |
| JP | 2006063099 | A | 3/2006 |
| JP | 2013166856 | A | 8/2013 |
| WO | 9807812 | A2 | 2/1998 |
| WO | 2013175659 | A1 | 11/2013 |

OTHER PUBLICATIONS

International Search Report and the Written Opinion of the International Searching Authority for the International Application No. PCT/US2014/066886, International Filing date of Nov. 21, 2014; mailed on Jan. 30, 2015, 5 pages.

Written Opinion of the Intenational Searching Authorty for International Application No. PCT/US2014/066886, International Filing date of Nov. 21, 2014; mailed Jan. 30, 2015, 6 pages.

* cited by examiner

*Primary Examiner* — Brian P Mruk
(74) *Attorney, Agent, or Firm* — Cantor Colburn LLP

(57) ABSTRACT

A dishwashing detergent comprising a builder; a surfactant; a first polymer comprising monoethylenically unsaturated C3-C6 carboxylic acid units and C1-C12 alkyl (meth)acrylate units; and a dispersant comprising a second polymer comprising monoethylenically unsaturated C3-C6 carboxylic acid units.

17 Claims, No Drawings

AUTOMATIC DISHWASHING DETERGENT

CROSS REFERENCE TO RELATED APPLICATIONS

This application is a National Stage application of PCT/US2014/066886, filed Nov. 21, 2014, which claims the benefit of EP Application No. 13290322.0, filed Dec. 20, 2013, both of which are incorporated herein by reference in their entirety.

FIELD

The present invention relates to an automatic dishwashing detergent.

BACKGROUND

Historically, phosphates have been used as builders for detergents, due to their excellent performance as chelating agents. Phosphates reduce the hardness of water, and disperse food and other organic materials during a washing cycle. However, due to aquatic plant stimulation effects, most jurisdictions have limited or banned the use of phosphates in detergents.

Accordingly, there remains an important need in the art for an improved and effective automatic dishwashing detergent which avoids the use of phosphates.

SUMMARY

A phosphate-free dishwashing composition, including:

5 to 99 wt % of a builder;

0.1 to 15 wt % of a surfactant of Formula 1, Formula 2, or a combination thereof, $$R_1O—(CH_2CH_2O)_m—(CH_2CHR_2O)_n—R_3 \quad (1),$$

$$R_3O—(CH_2CHR_2O)_{n/2}—(CH_2CH_2O)_{m/2}—R_5O—(CH_2CH_2O)_{m/2}—(CH_2CHR_2O)_{n/2}—R_3 \quad (2),$$

wherein $R_1$ is a C8-C24 alkyl group, $R_2$ is a C1-C5 alkyl group, $R_3$ is hydrogen, a C1-C12 alkyl group, a C1-C12 arylalkyl group, or a group represented by the Formula 3, $$—CH_2CH(OH)CH_2\text{-}E\text{-}R_4, \quad (3)$$

wherein E is a C1-C8 alkylene group or an oxygen atom, and $R_4$ is a C1-C8 alkyl group, m is a number between 1 and 100, and n is a number between 0 and 50, and $R_5$ is a C1-C8 alkylene group;

0.05 and 5 wt % of a first polymer having a weight-average molecular weight between 35,000 and 100,000 g/mol and including 22 to 80 wt % of monoethylenically unsaturated C3-C6 carboxylic acid units, and 20 to 78 wt % of C1-C12 alkyl (meth)acrylate units; and 0.5 to 10 wt % of a dispersant including a second polymer having a weight-average molecular weight between 1,000 and 30,000 g/mol and including 50 to 100 wt % of monoethylenically unsaturated C3-C6 carboxylic acid units.

A phosphate-free dishwashing composition, including:

5 to 99 wt % of a builder;

1 to 8 wt % of a surfactant of Formula 1, $$R_1O—(CH_2CH_2O)_m—(CH_2CHR_2O)_n—R_3 \quad (1),$$

wherein $R_1$ is a C8-C24 alkyl group, $R_2$ is a C1-C5 alkyl group, $R_3$ is hydrogen, m is a number between 10 and 30, and n is a number between 0 and 8;

0.05 and 1 wt % of a first polymer having a weight-average molecular weight between 35,000 and 100,000 g/mol and including 22 to 80 wt % of monoethylenically unsaturated C3-C6 carboxylic acid units, and 20 to 78 wt % of C1-C12 alkyl acrylate units; and 1 to 8 wt % of a dispersant including a second polymer having a weight-average molecular weight between 1,000 and 30,000 g/mol and including 50 to 100 wt % of monoethylenically unsaturated C3-C6 carboxylic acid units.

A method of manufacturing a dishwashing composition, the method including contacting 5 to 99 wt % of a builder;

0.1 to 15 wt % of a surfactant of Formula 1, Formula 2, or a combination thereof, $$R_1O—(CH_2CH_2O)_m—(CH_2CHR_2O)_n—R_3 \quad (1),$$

$$R_3O—(CH_2CHR_2O)_{n/2}—(CH_2CH_2O)_{m/2}—R_5O—(CH_2CH_2O)_{m/2}—(CH_2CHR_2O)_{n/2}—R_3 \quad (2),$$

wherein $R_1$ is a C8-C24 alkyl group, $R_2$ is a C1-C5 alkyl group, $R_3$ is hydrogen or a C1-C12 alkyl or arylalkyl group or a group represented by the Formula 3, $$—CH_2CH(OH)CH_2\text{-}E\text{-}R_4, \quad (3),$$

wherein E is a C1-C8 alkylene group or an oxygen atom, and $R_4$ is a C1-C8 alkyl group, m is a number between 1 and 100, and n is a number between 0 and 50, and $R_5$ is a C1-C8 alkylene group;

0.05 and 5 wt % of a first polymer having a weight-average molecular weight between 35,000 and 100,000 g/mol and including 22 to 80 wt % of monoethylenically unsaturated C3-C6 carboxylic acid units, and 20 to 78 wt % of C1-C12 alkyl (meth)acrylate units; and 0.5 to 10 wt % of a dispersant including a second polymer having a weight-average molecular weight between 1,000 and 30,000 g/mol and including 50 to 100 wt % of monoethylenically unsaturated C3-C6 carboxylic acid units.

DETAILED DESCRIPTION

Use of a specific cleaning combination, in particular a low foam surfactant in combination with a hydrophobically-modified polymer and a dispersant, provides desirable performance in a phosphate-free dishwashing detergent composition. While not wanting to be bound by theory, it is believed that this cleaning combination provides improved food soil emulsification, thereby preventing redeposition of food soil, and provides improved chelation of metal ions, thereby preventing inorganic scale, as well as improving the dispersion of those inorganic crystals that manage to form, thus preventing their adhesion to and growth on washware surfaces.

In an embodiment, the dishwashing composition comprises 5 to 99 wt %, specifically 10 to 97 wt %, more specifically 15 to 95 wt % of a builder; 0.1 to 15 wt %, specifically 0.5 to 10 wt %, more specifically 1 to 6 wt % of a surfactant; 0.05 and 5 wt %, specifically 0.1 and 4 wt %, more specifically 0.2 and 3 wt % of a first polymer; and 0.5 to 10 wt %, specifically 1 to 9 wt %, more specifically 2 to 8 wt % of a dispersant comprising a second polymer, each based on a total weight of the dishwashing composition.

The surfactant component is preferably a low foam surfactant, and may comprise a combination of low foam surfactants. The surfactant component assists in dissolving and/or emulsifying certain types of soils. The surfactant component is also useful for surface wetting, which helps deliver the composition to the ware surface. The surfactant comprises a nonionic surfactant, and may also optionally comprise an anionic surfactant, an amphoteric surfactant, a cationic surfactant, or a combination thereof. It is to be appreciated that other types of surfactants may also be used. The nonionic surfactant may be an alkoxylated nonionic surfactant. Nonionic surfactants suitable for use in the composition include copolymers having ethylene oxide (EO) units, as well as propylene oxide (PO) and/or butylene oxide (BO) units. The surfactant may comprise a di-block polymer comprising an EO block and a PO block or a center block of EO with attached PO blocks. Further, this surfactant may have blocks of either ethylene oxide or propylene oxide in the molecules. The surfactant may also include butylene oxide (BO) blocks, and may include incorporations of two or three alkylene oxides, e.g., to provide an EO/PO/BO, triblock copolymer, for example. Use of an alkyl EO/BO diblock copolymer is specifically mentioned.

The surfactant comprises a surfactant of Formula 1, Formula 2, or a combination thereof, $$R_1O—(CH_2CH_2O)_m—(CH_2CHR_2O)_n—R_3 \quad (1),$$

$$R_3O—(CH_2CHR_2O)_{n/2}—(CH_2CH_2O)_{m/2}—R_5O—(CH_2CH_2O)_{m/2}—(CH_2CHR_2O)_{n/2}—R_3 \quad (2),$$

wherein $R_1$ is a C8-C24 alkyl group, $R_2$ is a C1-C5 alkyl group, $R_3$ is hydrogen, a C1-C12 alkyl group, a C1-C12 arylalkyl group, or a group represented by the Formula 3, $$—CH_2CH(OH)CH_2\text{-}E\text{-}R_4, \quad (3)$$

wherein E is a C1-C8 alkylene group or an oxygen atom, and $R_4$ is a C1-C8 alkyl group, m is a number between 1 and 100, and n is a number between 0 and 50, and $R_5$ is a C1-C8 alkylene group.

$R_1$ may be a C10-C20 alkyl group or a C12-C16 alkyl group, specifically a C10-C18 alkyl group. $R_2$ may be a C1-C4 alkyl group, specifically a C2-C4 alkyl group. $R_3$ may be hydrogen, a C1-C8 alkyl group, a C1-C8 arylalkyl group, or a group represented by Formula 3, specifically $R_3$ may be hydrogen, a C2-C4 alkyl group, a C2-C4 arylalkyl group, or a group represented by Formula 3. In Formula 3, E may be a C1-C6 alkylene group or an oxygen atom, or a C1-C4 alkylene group or an oxygen atom, and $R_4$ may be a C1-C6 alkyl group, or a C1-C4 alkyl group. $R_5$ may be a C1-C6 alkylene group, or a C1-C4 alkylene group. Each of $R_1$, $R_2$, $R_3$, $R_4$, $R_5$ and E may independently be branched or linear. An embodiment in which the surfactant comprises, e.g., consists of, a surfactant of Formula 1 wherein $R_2$ is a C2 alkyl group is specifically mentioned. An embodiment in which $R_1$ is a linear C10-C18 alkyl group, $R_2$ is a methyl or ethyl group, and $R_3$ is hydrogen is specifically mentioned.

The nonionic alkoxylated surfactant may be a condensation product of an aliphatic alcohol or diol with from 1 to 100 moles of an alkylene oxide, in particular 5 to 50, or from 1 to 40 moles, or 2 to 30 moles, of ethylene oxide, propylene oxide, and/or butylene oxide. The alkyl chain of the aliphatic alcohol may either be straight or branched, primary or secondary, and may contain from 6 to 22 carbon atoms.

The nonionic surfactant may also optionally comprise a polyhydroxy fatty acid amide, such as those having the structural formula $R^2CONR^1Z$ wherein $R^1$ is H, a $C_1$-$C_{18}$, specifically a $C_1$-$C_4$ hydrocarbyl, 2-hydroxyethyl, 2-hydroxypropyl, ethoxy, propoxy, or a combination thereof, specifically $C_1$-$C_4$ alkyl, more specifically $C_1$ or $C_2$ alkyl, most specifically $C_1$ alkyl (i.e., methyl); and $R^2$ is a $C_5$-$C_{31}$ hydrocarbyl, specifically a straight-chain $C_5$-$C_{19}$ or $C_7$-$C_{19}$ alkyl or alkenyl, more specifically straight-chain $C_9$-$C_{17}$ alkyl or alkenyl, most specifically a straight-chain $C_{11}$-$C_{17}$ alkyl or alkenyl, or a combination thereof; and Z is a polyhydroxyhydrocarbyl having a linear hydrocarbyl chain with at least 3 hydroxyls directly connected to the chain, or an alkoxylated derivative thereof, specifically an ethoxylated, propoxylated, or butyloxylated derivative thereof. Z may be derived from a reducing sugar in a reductive amination reaction, such as a group of the formula $—CH_2—(CHOH)_n—CH_2OH$ or $—CH(CH_2OH)—(CHOH)_{n-1}—CH_2OH$ wherein n is 3 to 5, preferably 4.

The nonionic surfactant may be present in an amount of 0.1 to 15 wt %, specifically 0.5 to 10 wt %, more specifically 1 to 6 wt %, based on a total weight of the dishwashing composition.

The first polymer comprises hydrophobic units and anionic units. In an embodiment the first polymer comprises 22 to 80 wt % of monoethylenically unsaturated C3-C6 carboxylic acid units, and 20 to 78 wt % of C1-C12 alkyl (meth)acrylate units, each based on a total weight of the first polymer. In an embodiment the first polymer is an acrylic polymer, i.e., one having at least 22 wt % polymerized units of the monoethylenically unsaturated C3-C6 carboxylic acid units, based on a total weight of the first polymer. The first polymer may comprise 10 to 80 wt %, specifically 15 to 75 wt %, more specifically 20 to 70 wt % of methacrylic acid units; 0 to 30 wt %, specifically 5 to 25 wt %, more specifically 10 to 20 wt % of acrylic acid units; and 20 to 70 wt %, specifically 25 to 65 wt %, more specifically 30 to 60 wt % of C1-C12 alkyl (meth)acrylate units, each based on a total weight of the first polymer.

In an embodiment, the first polymer comprises 10 to 34 wt %, specifically 12 to 32 wt %, more specifically 14 to 30 wt % of methacrylic acid units; 10 to 20 wt %, specifically 12 to 18 wt %, more specifically 14 to 16 wt % of acrylic acid units; and 46 to 70 wt %, specifically 44 to 68 wt %, more specifically 42 to 66 wt % of C1-C12 alkyl (meth)acrylate units, each based on a total weight of the first polymer.

In another embodiment, the first polymer comprises 55 to 80 wt %, specifically 58 to 74 wt %, more specifically 61 to 71 wt % of the methacrylic acid units; and 25 to 50 wt %, specifically 28 to 45 wt %, more specifically 31 to 40 wt % of the C1-C12 alkyl (meth)acrylate units, each based on a total weight of the first polymer. Of the of the C1-C12 alkyl (meth)acrylate units, the first polymer may comprise 10 to 35 wt %, specifically 12 to 30 wt %, more specifically 14 to 25 wt % of ethyl acrylate units; and 10 to 35 wt %, specifically 12 to 30 wt %, more specifically 14 to 25 wt % of butyl acrylate units, each based on a total weight of the first polymer.

In these embodiments the first polymer can comprise at least 25 wt %, specifically at least 30 wt %, more specifically at least 35 wt % polymerized units of a $C_1$-$C_{12}$ alkyl (meth)acrylate, based on a total weight of the first polymer. In an embodiment the first polymer comprises no more than 80 wt % of polymerized units of the $C_1$-$C_{12}$ alkyl (meth) acrylate, specifically 30 to 75 wt %, more specifically 30 to 70 wt %, based on a total weight of the first polymer. In an embodiment, the $C_1$-$C_{12}$ alkyl (meth)acrylate units are $C_2$-$C_4$ alkyl (meth)acrylate units, specifically ethyl acrylate (EA) and/or butyl acrylate (BA) units. In an embodiment, the first polymer contains no more than 15 wt % of polymerized units of (meth)acrylate esters that are not $C_1$-$C_{12}$ alkyl (meth)acrylates, specifically no more than 10 wt %, more specifically no more than 7 wt %, or no more than 4 wt % of polymerized units of (meth)acrylate esters. Of the $C_1$-$C_{12}$ alkyl (meth)acrylate, the methyl acrylate (MA), EA, and BA units may each independently be present in amounts of 0 to 100 wt %, specifically 10 to 90 wt %, more specifically 20 to 80 wt %, or 30 to 70 wt %, or 40 to 60 wt %. In an embodiment, the first polymer comprises 45 to 70 wt % of the $C_1$-$C_{12}$ alkyl (meth)acrylate units, specifically 50 to 65 wt %, more specifically 55 to 60 wt %, based on a total weight of the first polymer. The monoethylenically unsaturated C3-C6 carboxylic acid units of the first polymer may be methacrylic acid units, acrylic acid units, or a combination thereof. Use of ethyl acrylate is specifically mentioned.

In another embodiment, the first polymer comprises 25 to 45 wt % of the $C_1$-$C_{12}$ alkyl (meth)acrylate units, specifically 30 to 40 wt %, more specifically 32 to 38 wt %, based on a total weight of the first polymer. An embodiment in which ethyl acrylate units are present in an amount of 12 to 25 wt %, specifically 15 to 20 wt %, and butyl acrylate units are present in an amount of 12 to 25 wt %, specifically 15 to 20 wt %, based on a total weight of the first polymer, is specifically mentioned.

In these embodiments, the first polymer has a weight average molecular weight ($M_w$) in the range from 10,000 to 150,000 Da, specifically from 10,000 to 130,000 Da, specifically from 15,000 to 120,000 Da, specifically from 20,000 to 100,000 Da, specifically from 35,000 to 80,000 Da.

In some embodiments, the first polymer further comprises one or more ethylenically unsaturated monomers such as esters of carboxylic acid anhydrides, imides, amides, styrenes, sulfonic acids, or a combination thereof. In some embodiments, this monomer is present in 1-30 wt % of the polymer. Sulfonic acid monomers include, for example, 2-(meth)acrylamido-2-methylpropanesulfonic acid, 4-styrenesulfonic acid, vinylsulfonic acid, 2-sulfoethyl(meth) acrylic acid, 2-sulfopropyl(meth)acrylic acid, 3-sulfopropyl (meth)acrylic acid, and 4-sulfobutyl(meth)acrylic acid and salts thereof. Further examples of ethylenically unsaturated monomers include, without limitation, maleic anhydride, vinyl acetic acid, acryloxypropionic acid, methyl acrylate, ethyl acrylate, butyl acrylate, methyl methacrylate, ethyl methacrylate, butyl methacrylate and isobutyl methacrylate; hydroxyalkyl esters of acrylic or methacrylic acids such as hydroxyethyl acrylate, hydroxypropyl acrylate, hydroxyethyl methacrylate, and hydroxypropyl methacrylate; acrylamide, methacrylamide, N-tertiary butyl acrylamide, N-methyl acrylamide, N,N-dimethyl acrylamide; acrylonitrile, methacryionitrile, allyl alcohol, allyl sulfonic acid, allyl phosphonic acid, vinylphosphonic acid, dimethylaminoethyl acrylate, dimethylaminoethyl methacrylate, phosphoethyl methacrylate, phosphonoethyl methacrylate (PEM), and sulfonoethyl methacrylate (SEM), N-vinyl pyrollidone, N-vinylformamide, N-vinylimidazole, ethylene glycol diacrylate, trimethylotpropane triacrylate, diallyl phthalate, vinyl acetate, styrene, divinyl benzene, allyl acrylate, 2-acrylamido-2-methyl propane sulfonic acid (AMPS) or its salts or a combination thereof.

The first polymer may be made by free-radical polymerization, e.g., free-radical emulsion polymerization in the presence of a C2-C24 alkanethiol. In a preferred embodiment, the first polymer is prepared by the free-radical emulsion polymerization technique, in which an agitated mixture of the ethylenically-unsaturated monomers, water, and a surfactant is reacted by the action of free-radicals generated by the decomposition of precursors such as alkali persulfates, azo compounds, or organic peracids, or peresters. The activation of these precursors may be by the action of elevated reaction temperature alone (thermal activation) or by the admixture of redox-active agents such as a combination of iron(II) sulfate and ascorbic acid (redox activation). In these cases, a chain-transfer agent is typically used to modulate polymer molecular weight. One class of preferred chain-transfer agents employed in emulsion polymerizations is the mercaptans (alkanethiols). Specifically mentioned are linear alkanethiols such as n-dodecyl mercaptan (n-dodecanethiol).

The dishwashing detergent composition contains from 0.05 to 5 wt %, specifically 0.1 to 4 wt %, more specifically 0.2 to 2 wt % of the first polymer, based on a total weight of the detergent composition. Specifically, the detergent composition may contain at least 0.1 wt % of the first polymer, specifically 0.2 wt %, specifically at least 0.3 wt %, specifically at least 0.5 wt %, specifically at least 0.8 wt %, specifically at least 1.0 wt % of the first polymer.

In addition the composition comprises a dispersant comprising a second polymer to help prevent the formation of inorganic scale. The dispersant may be present in an amount of 0.5 to 10 wt %, specifically 1 to 8 wt %, more specifically 2 to 6 wt %. Especially mentioned in this regard are homo- and copolymers containing at least 50 wt %, specifically 50 to 100 wt %, more specifically 60 to 95 wt % of monoethylenically unsaturated C3-C6 carboxylic acid units, specifically (meth)acrylic acid units. The weight-average molecular weights of these polymers are between 1,000 and 30,000 g/mol, preferably between 1,000 and 28,000 g/mol, and most preferably between 2,000 and 26,000 g/mol. Monomers units which may be used in conjunction with monoethylenically unsaturated C3-C6 carboxylic acids include ethylenically-unsaturated dicarboxylic acids (such as maleic acid and itaconic acid), sulfonate monomers (such as 2-acrylamido-2-methylpropanesulfonic acid sodium salt), acrylamide, N-alkyl acrylamides, and monomers containing (meth)acrylic esters of polyethylene glycol monoalkyl ethers.

Low-molecular weight dispersant polymers may be prepared by free-radical polymerization. A preferred method for preparing these polymers is by homogeneous polymerization in a solvent. The solvent may be water or an alcoholic solvent such as 2-propanol or 1,2-propanediol. The free-radical polymerization is initiated by the decomposition of precursor compounds such as alkali persulfates or organic peracids and peresters. The activation of these precursors may be by the action of elevated reaction temperature alone (thermal activation) or by the admixture of redox-active agents such as a combination of iron(II) sulfate and ascorbic acid (redox activation). In these cases, a chain-transfer agent is typically used to modulate polymer molecular weight. One class of preferred chain-transfer agents employed in solution polymerizations is the alkali or ammonium bisulfites. Specifically mentioned is sodium meta-bisulfite.

The dishwashing composition is substantially free of phosphate-containing compounds, making the dishwashing composition more environmentally acceptable. Phosphate-free refers to a composition, mixture, or ingredients to which phosphate- and/or oligophosphate-containing compounds are not added. Should a phosphate-containing compound be present through contamination of a phosphate-free composition, mixture, or ingredient, the composition is encompassed by the invention, and the level of phosphate-containing compounds in the resulting cleaning composition is substantially phosphate-free, meaning less than about 0.5 wt %, less than about 0.1 wt %, or less than about 0.05 wt %, or less than about 0.01 wt %, based on a total weight of the dishwashing composition. In various embodiments, the dishwashing composition is free of phosphate-containing compounds, that is, no amount of phosphate compounds are detectable.

The content of the phosphate and the oligophosphate compounds, if either or both are present, can be determined by analysis for phosphorus, and the content of the phosphate and the oligophosphate compounds can be expressed as a content of phosphorus, i.e., as P, in the composition. In an embodiment, if a phosphate compound is present, a content of the phosphate compound in the phosphate-free dishwashing composition is less than 0.5 wt % as phosphorus, or 0.0001 wt % to 0.5 wt % as phosphorus, or 0.0005 wt % to 0.1 wt % as phosphorus, or 0.01 wt % to 0.1 wt % as phosphorus, based on a total weight of the dishwashing composition. In another embodiment, a total content of a phosphate and an oligophosphate compound, if either or both are present in the phosphate-free dishwashing composition, is less than 0.5 wt % as phosphorus, or 0.0001 wt % to 0.5 wt % as phosphorus, or 0.0005 wt % to 0.1 wt % as phosphorus, or 0.01 wt % to 0.1 wt % as phosphorus, based on a total weight of the dishwashing composition.

In an embodiment, the phosphate-free dishwashing composition may comprise a phosphonate, and a content of the phosphonate may be 0.01 wt % to 5 wt % as phosphorus, or 0.1 wt % to 1 wt % as phosphorus, based on a total weight of the dishwashing composition, wherein the phosphonate content is expressed as a content of phosphorus in the composition. In an embodiment a phosphonate is not present, or content of the phosphonate is less than 5 wt % as phosphorus, based on a total weight of the dishwashing composition.

The detergent composition may also contain 5 to 99 wt %, specifically 80 to 98 wt %, more specifically 90 to 96 wt % of other ingredients, such as a builder, bleach, bleach activator, enzyme, foam suppressant, color, fragrance, antibacterial agent, filler, additional surfactant, or additional polymer.

The builder may be an inorganic builder such as sodium carbonate, or biodegradable builder, and comprises a chelant, such as sodium citrate and/or citric acid. An aminocarboxylate, methylglycine diacetic acid (MGDA), glutamic acid diacetic acid (GLDA), and their sodium salts, and 2-hydroxyethyliminodiacetic acid disodium salt (HEIDA), may be included to provide a biodegradable chelant in the builder. The builder may be present in the detergent composition in an amount of 5 to 99 wt %, specifically from 10 to 96 wt %, most specifically from 15 to 92 wt %, based on a total weight of the composition. Suitable water-soluble builder compounds include the water soluble monomeric carboxylates, or their acid forms. The builder may also comprise a fatty acid and/or optionally a salt thereof, specifically the sodium salt. Other builder/chelant compounds include nitrilotriacetic acid, N. N' ethylenediaminetetraacetic acid, diethylenetriaminepentaacetic acid, glycine-N,N-diacetic acid, methylglycine-N,N-diacetic acid, 2-hydroxyethyliminodiacetic acid, glutamic acid-N,N-diacetic acid, 3-hydroxy-2,2'-iminodisuccinate, N,N'-ethylenediaminedisuccinate aspartic acid-diacetic acid, N,N'-ethylenediamine disuccinic acid, iminodisuccinic acid, aspartic acid, aspartic acid-N,N-diacetate, beta-alaninediacetic acid, polyaspartic acid, a salt thereof, or a combination thereof. In some embodiments, the builder is sodium citrate, citric acid, or sodium carbonate, poly(itaconic acid), poly(aspartic acid), or a combination thereof.

The fragrance may comprise at least one component comprising a coating agent and/or carrier material, specifically an organic polymer carrying the fragrance, or an encapsulate enclosing the fragrance, for example starch or other cellulosic material encapsulate.

Fillers, which may be in the form of tablets or powders, are inert, water-soluble substances, typically sodium or potassium salts, e.g., sodium or potassium sulfate and/or chloride, and may be present in amounts ranging of 0 to 75 wt %, specifically from 5 to 50 wt %, specifically from 10 to 40 wt %. Fillers in gel formulations may include those mentioned above and also water. Fragrances, dyes, foam suppressants, corrosion inhibitors, enzymes and antibacterial agents may total no more than 5 wt % of the composition.

In some embodiments, the detergent further comprises at least one bleaching agent or enzyme. A preferred bleaching agent is sodium percarbonate. Specifically, the composition contains from 5 to 25 wt % of a percarbonate salt, specifically from 7 to 20 wt %, specifically from 8 to 15 wt %. In some embodiments, the enzyme is at least one of lipases, proteases, or amylases.

Specifically, the composition has a pH (at 1 wt % in water) of at least 9, specifically at least 10.5; specifically the pH is no greater than 12.5, specifically no greater than 11.5. In some embodiments, the detergent further comprises a phosphonate, specifically hydroxyethylidene-1,1 diphosphonic acid (HEDP) or 2-phosphonobutane-1,2,4-tricarboxylic acid (PBTC).

The solvent may be a polyglycol, alcohol, diol, triol, glycol ether, or water. A coupling agent may be used. A binder such as polyethylene glycol (PEG); a disintegrant such as a superabsorbent polymer, or cellulosic; and corrosion inhibitors such as a (di)silicate or a zinc salt may be used. A co-solvent such as (poly)propylene glycol, e.g., propylene glycol, can be used.

The dishwashing composition may be used in an automatic dishwashing machine. In practice, the composition may be formulated in any suitable form, such as a tablet, powder, monodose unit, multi-component monodose unit, sachet, paste, liquid, or gel. The components of the detergent composition may be located in distinct compartments, e.g., sealed in a pouch comprising a water-soluble polymer, so as to release at a selected point during the wash cycle, e.g., at a time different than release of the biodegradable filler, if present. The composition may be sealed in a multi-chamber pouch in which the content of each chamber is the same or different. For example, the fragrance may be disposed within a capsule to provide release during a selected cycle. With selection of an appropriate product form and addition time, the dishwashing composition may be present in the prewash, main wash, penultimate rinse, final rinse, or any combination of these cycles. The concentration of the dishwashing composition as a percentage of total liquid in the dishwasher may be 0.1 to 1 wt %, specifically from 0.2 to 0.7 wt %.

The dishwashing composition may be formed by various methods. The dishwashing composition may be formed by contacting, e.g. mixing, all of the components together. The dishwashing composition is not limited to any particular method of manufacture.

The dishwashing composition may be used by contacting a surface to be washed with the composition.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

"Ethylenically unsaturated monomers" means molecules having one or more carbon-carbon double bonds, which renders them polymerizable. As used herein, ethylenically unsaturated monomers include, without limitation, carboxylic acids, esters of carboxylic acids, carboxylic acid anhydrides, imides, amides, styrenes, sulfonic acids, and combinations thereof.

"Alkyl" as used herein means a straight or branched chain, saturated, monovalent hydrocarbon group (e.g., methyl or hexyl).

"Alkylene" means a straight or branched chain, saturated, divalent aliphatic hydrocarbon group, (e.g., methylene ($—CH_2—$) or, propylene ($—(CH_2)_3—$)).

"Alkenyl" means a straight or branched chain, monovalent hydrocarbon group having at least one carbon-carbon double bond (e.g., ethenyl ($—HC{=}CH_2$)).

"Arylalkyl" means a substituted or unsubstituted aryl group covalently linked to an alkyl group that is linked to a compound (e.g., a benzyl is a C7 arylalkyl group).

A "hydrocarbyl group" as used herein means a group having the specified number of carbon atoms and the appropriate valence in view of the number of substitutions shown in the structure. Hydrocarbyl groups contain at least carbon and hydrogen, and may optionally contain 1 or more (e.g., 1-8) heteroatoms selected from N, O, S, Si, P, or a combination thereof. Hydrocarbyl groups may be unsubstituted or substituted with one or more substituent groups up to the valence allowed by the hydrocarbyl group independently selected from a C1-30 alkyl, C2-30 alkenyl, C2-30 alkynyl, C6-30 aryl, C7-30 arylalkyl, C1-12 alkoxy, C1-30 heteroalkyl, C3-30 heteroarylalkyl, C3-30 cycloalkyl, C3-15 cycloalkenyl, C6-30 cycloalkynyl, C2-30 heterocycloalkyl, halogen (F, Cl, Br, or I), hydroxy, nitro, cyano, amino, azido, amidino, hydrazino, hydrazono, carbonyl, carbamyl, thiol, carboxy (C1-6alkyl) ester, carboxylic acid, carboxylic acid salt, sulfonic acid or a salt thereof, and phosphoric acid or a salt thereof.

"(Meth)acrylate" refers to acrylate and methacrylate.

"Alkali metal" means a metal of Group 1 of the Periodic Table of the Elements, i.e., lithium, sodium, potassium, rubidium, cesium, and francium.

"Alkaline-earth metal" means a metal of Group 2 of the Periodic Table of the Elements, i.e., beryllium, magnesium, calcium, strontium, barium, and radium.

EXAMPLES

Dishwashing compositions are evaluated by combining them with a base comprising, each optionally, a builder which comprises a chelant, corrosion inhibitor, bleaching agent, bleach activator, additional surfactant, enzyme, binder, filler, co-solvent, rheology modifier, $CaCO_3$ threshold inhibitor, and filler and to provide a detergent as follows. All values in Table 1 are in weight percent (wt %).

TABLE 1

| Component | Purpose | Formula 1 | Formula 2 |
|---|---|---|---|
| Sodium citrate | Builder (chelant) | 20 | 20 |
| Aminocarboxylate (MGDA) | Builder (chelant) | 10 | 10 |
| Sodium carboante | Builder | 20 | 20 |
| Sodium bicarbonate | Builder | 10 | 10 |
| Sodium disilicate | Corrosion inhibitor/co-builder | 0 | 0 |
| Sodium percarbonate | Peroxygen bleach | 15 | 15 |
| tetraacetyl ethylene diamine (TAED) | Bleach activator | 4 | 4 |
| Alcohol ethoxylate | Surfactant | 2 | 2 |
| Protease/amylase | Enzymes | 3 | 3 |
| Polymer A or Polymer B | Food soil emulsifier | 0 | 0.2 |
| Second polymer | Dispersants | 5 | 5 |
| Phosphonate | CaCO3 threshold inhibitor | 1 | 1 |
| Sodium sulfate | filler | 10 | 9.8 |

Polymer A is an emulsion copolymer of acrylic acid (15 wt %), methacrylic acid (27 wt %), and ethyl acrylate (58 wt %). The weight-average molecular weight (MW) was approximately 40,000 grams per mole (g/mol).

Polymer B is an emulsion copolymer of methacrylic acid (65 wt %), ethyl acrylate (17.5 wt %), and butyl acrylate (17.5 wt %). The weight-average MW was approximately 40,000 g/mol.

To determine filming performance of automatic dishwashing detergent containing each of Polymer A or Polymer B, automatic dishwashing (ADW) formulas were prepared having the food emulsifier polymer according to Formula 2 and each sample ADW formula was used to wash glasses in automatic dishwashing machines under the following conditions:

Machines: Miele G1222SC Labor.

Program: prewash, main wash at 65° C.

Water hardness: 37.5° French degree (fH), ratio Ca/Mg 3/1, $HCO_3$ hardness=25° fH.

Detergent dosage: 20 grams per wash.

The glasses were removed after the third, sixth and tenth cycles.

Glasses were evaluated in a dark light box by visual observation and rated for filming and spotting.

The glasses were handled with cotton gloves and the filming performance was assessed by trained panelists. The evaluation was performed according to ASTM D3556 Standard test method for deposition on glass ware during mechanical dishwashing (Designation D3556-85, re-approved 2009), the content of which is incorporated herein by reference in its entirety, following the scoring system in Table 2 in a light chamber:

TABLE 2

| Score | Description |
|---|---|
| 1 | No filming |
| 2 | Barely perceptible filming |
| 3 | Slight film |
| 4 | Moderate film |
| 5 | Virtually completely covered with heavy film |

Each run was done in presence of 50 grams frozen ballast added during main wash. The frozen ballast contained Margarine (10.2 wt %); Milk (5.1 wt %); Egg yolk (5.3 wt %); Benzoic acid (0.1 wt %); Potato Starch (0.5wt %); Mustard (2.5 wt %); Ketchup (2.5 wt %); Instant Gravy (2.5 wt %); and Water (71.2 wt %).

Performance

The results of the evaluation are provided in Table 3.

TABLE 3

| | Formula 1 | Formula 2 Polymer A | Formula 2 Polymer B |
|---|---|---|---|
| Film cycle 3 | 1.25 | 1 | 1 |
| Film cycle 6 | 2 | 1 | 1 |
| Film cycle 10 | 1.75 | 1.25 | 1.25 |

As shown in Table 3, the detergents of Formula 2, which comprised the emulsion copolymer Polymer A or Polymer B, provided improved performance relative to the detergent of Formula 1, which did not include the emulsion copolymer.

What is claimed is:

1. A phosphate-free dishwashing composition, comprising:

5 to 99 wt % of a builder;

0.1 to 15 wt % of a surfactant of Formula 1, Formula 2, or a combination thereof, $$R_1O—(CH_2CH_2O)_m—(CH_2CHR_2O)_n—R_3 \quad (1),$$

$$R_3O—(CH_2CHR_2O)_{n/2}—(CH_2CH_2O)_{m/2}—R_5O—(CH_2CH_2O)_{m/2}—(CH_2CHR_2O)_{n/2}—R_3 \quad (2),$$

wherein $R_1$ is a $C_8$-$C_{24}$ alkyl group, $R_2$ is a $C_1$-$C_5$ alkyl group, $R_3$ is hydrogen, a $C_1$-$C_{12}$ alkyl group, a $C_1$-$C_{12}$ arylalkyl group, or a group represented by the Formula 3, $$—CH_2CH(OH)CH_2\text{-}E\text{-}R_4, \quad (3)$$

wherein E is a $C_1$-$C_8$ alkylene group or an oxygen atom, and $R_4$ is a $C_1$-$C_8$ alkyl group, m is a number between 1 and 100, and n is a number between 0 and 50, and $R_5$ is a $C_1$-$C_8$ alkylene group;

0.05 to 5 wt % of a first polymer having a weight-average molecular weight between 35,000 and 100,000 g/mol and comprising 22 to 80 wt % of monoethylenically unsaturated $C_3$-$C_6$ carboxylic acid units, and 20 to 78 wt % of $C_1$-$C_{12}$ alkyl (meth)acrylate units; and 0.5 to 10 wt % of a dispersant comprising a second polymer having a weight-average molecular weight between 1,000 and 30,000 g/mol and comprising 50 to 100 wt % of monoethylenically unsaturated $C_3$-$C_6$ carboxylic acid units;

wherein the phosphate-free dishwashing composition comprises less than 0.5 wt % of a phosphate-containing compound, based on a total weight of the dishwashing composition.

2. The composition of claim 1, wherein the surfactant is a low foam surfactant.

3. The composition of claim 1, wherein $R_1$ is a linear $C_{10}$-$C_{18}$ alkyl group, $R_2$ is a methyl or ethyl group, and $R_3$ is hydrogen.

4. The composition of claim 1, wherein the monoethylenically unsaturated $C_3$-$C_6$ carboxylic acid units of the first polymer are methacrylic acid units, acrylic acid units, or a combination thereof.

5. The composition of claim 1, wherein the first polymer comprises 10 to 80 wt % of methacrylic acid units, 0 to 30 wt % of acrylic acid units, and 20 to 70 wt % of $C_1$-$C_{12}$ alkyl (meth)acrylate units.

6. The composition of claim 1, wherein the $C_1$-$C_{12}$ alkyl (meth)acrylate is ethyl acrylate, butyl acrylate, or a combination thereof.

7. The composition of claim 1, wherein the first polymer comprises 10 to 34 wt % of methacrylic acid units, 10 to 20 wt % of acrylic acid units, and 46 to 70 wt % of $C_1$-$C_{12}$ alkyl (meth)acrylate units.

8. The composition of claim 1, wherein the first polymer comprises 55 to 80 wt % of methacrylic acid units, 10 to 35 wt % of ethyl acrylate units, and 10 to 35 wt % of butyl acrylate units.

9. The composition of claim 1, wherein the composition comprises less than 0.1 wt % of the phosphate-containing compound.

10. The composition of claim 1, the composition comprises 0 to less than 0.01 wt % of a phosphate-containing compound.

11. The composition of claim 1, wherein the first polymer is a product of free-radical emulsion polymerization in the presence of a $C_2$-$C_{24}$ alkanethiol.

12. The composition of claim 1, wherein the phosphate-containing compound comprises a phosphate and an oligophosphate; and wherein a total content of the phosphate and the oligophosphate compound, if present in the phosphate-free dishwashing composition, is less than 0.05 wt %, based on a total weight of the dishwashing composition.

13. The composition of claim 1, wherein the composition is sealed in a pouch comprising at least one chamber, in which a content of each chamber is the same or different.

14. A phosphate-free dishwashing composition, comprising:

5 to 99 wt % of a builder;

1 to 8 wt % of a surfactant of Formula 1, $$R_1O—(CH_2CH_2O)_m—(CH_2CHR_2O)_n—R_3 (1),$$

wherein $R_1$ is a $C_8$-$C_{24}$ alkyl group, $R_2$ is a $C_1$-$C_5$ alkyl group, $R_3$ is hydrogen, m is a number between 10 and 30, and n is a number between 0 and 8;

0.05 to 1 wt % of a first polymer having a weight-average molecular weight between 35,000 and 100,000 g/mol and comprising 22 to 80 wt % of monoethylenically unsaturated $C_3$-$C_6$ carboxylic acid units, and 20 to 78 wt % of $C_1$-$C_{12}$ alkyl acrylate units; and 1 to 8 wt % of a dispersant comprising a second polymer having a weight-average molecular weight between 1,000 and 30,000 g/mol and comprising 50 to 100 wt % of monoethylenically unsaturated $C_3$-$C_6$ carboxylic acid units;

wherein the phosphate-free dishwashing composition comprises less than 0.5 wt % of a phosphate-containing compound, based on a total weight of the dishwashing composition.

15. The composition of claim 14, wherein the composition comprises less than 0.1 wt % of the phosphate-containing compound.

16. A method of dishwashing, the method comprising contacting a surface to be washed with the dishwashing composition of claim 1.

17. A method of manufacturing a dishwashing composition, the method comprising contacting 5 to 99 wt % of a builder;

0.1 to 15 wt % of a surfactant of Formula 1, Formula 2, or a combination thereof, $$R_1O—(CH_2CH_2O)_m—(CH_2CHR_2O)_n—R_3 \quad (1),$$

$$R_3O—(CH_2CHR_2O)_{n/2}—(CH_2CH_2O)_{m/2}—R_5O—(CH_2CH_2O)_{m/2}—(CH_2CHR_2O)_{n/2}—R_3 \quad (2),$$

wherein $R_1$ is a $C_8$-$C_{24}$ alkyl group, $R_2$ is a $C_1$-$C_5$ alkyl group, $R_3$ is hydrogen or a $C_1$-$C_{12}$ alkyl or arylalkyl group or a group represented by the Formula 3, $$—CH_2CH(OH)CH_2\text{-}E\text{-}R_4, \quad (3),$$

wherein E is a $C_1$-$C_8$ alkylene group or an oxygen atom, and $R_4$ is a $C_1$-$C_8$ alkyl group, m is a number between 1 and 100, and n is a number between 0 and 50, and $R_5$ is a $C_1$-$C_8$ alkylene group;

0.05 to 5 wt % of a first polymer having a weight-average molecular weight between 35,000 and 100,000 g/mol and comprising 22 to 80 wt % of monoethylenically unsaturated $C_3$-$C_6$ carboxylic acid units, and 20 to 78 wt % of $C_1$-$C_{12}$ alkyl (meth)acrylate units; and 0.5 to 10 wt % of a dispersant comprising a second polymer having a weight-average molecular weight between 1,000 and 30,000 g/mol and comprising 50 to 100 wt % of monoethylenically unsaturated $C_3$-$C_6$ carboxylic acid units;

wherein the dishwashing composition comprises less than 0.5 wt % of a phosphate-containing compound, based on a total weight of the dishwashing composition.

* * * * *